US012691335B2

(12) United States Patent
Knarr et al.

(10) Patent No.: US 12,691,335 B2
(45) Date of Patent: Jul. 28, 2026

(54) SYSTEM FOR CONTROLLING EXERCISE EQUIPMENT BASED ON USER PACE AND MOTION ANALYSIS

(71) Applicant: Board of Regents of the University of Nebraska, Lincoln, NE (US)

(72) Inventors: Brian Knarr, Omaha, NE (US); Travis Vanderheyden, Omaha, NE (US); Russell Buffum, Omaha, NE (US)

(73) Assignee: Board of Regents of the University of Nebraska, Lincoln, NE (US)

( * ) Notice: Subject to any disclaimer, the term of this patent is extended or adjusted under 35 U.S.C. 154(b) by 122 days.

(21) Appl. No.: 18/563,817

(22) PCT Filed: Jun. 24, 2022

(86) PCT No.: PCT/US2022/034914
§ 371 (c)(1),
(2) Date: Nov. 22, 2023

(87) PCT Pub. No.: WO2022/272070
PCT Pub. Date: Dec. 29, 2022

(65) Prior Publication Data

US 2024/0216761 A1 Jul. 4, 2024

Related U.S. Application Data

(60) Provisional application No. 63/214,430, filed on Jun. 24, 2021.

(51) Int. Cl.
*A63B 24/00* (2006.01)
*A63B 22/02* (2006.01)

(52) U.S. Cl.
CPC ..... *A63B 24/0087* (2013.01); *A63B 22/025* (2015.10); *A63B 24/0021* (2013.01);
(Continued)

(58) Field of Classification Search
CPC ..... A63B 24/0087; A63B 22/025; A63B 24/0021; A63B 2024/0025;
(Continued)

(56) References Cited

U.S. PATENT DOCUMENTS 7,220,219 B2 5/2007 Papadopoulos et al.
8,480,541 B1 * 7/2013 Brunts ..... A63B 22/025 482/7
(Continued)

FOREIGN PATENT DOCUMENTS

CN 112206483 A * 1/2021 ..... A63B 22/025
EP 1145682 A2 10/2001
EP 2060229 B1 6/2011

OTHER PUBLICATIONS

International Search Report and Written Opinion mailed on Jan. 26, 2018 for International Application No. PCT/US2017/057050.
(Continued)

*Primary Examiner* — Andrew M Kobylarz
(74) *Attorney, Agent, or Firm* — Akona IP PC

(57) ABSTRACT

A system for controlling exercise equipment based on user pace and motion analysis is disclosed. The system includes a control unit communicatively coupled with a center of mass (COM) sensor and one or more additional sensors. The COM sensor is configured to track a position of a body of a user on the exercise equipment over time. The one or more additional sensors are configured to track off-center movements of the user over time. The control unit is configured to modulate an adjustable parameter of the exercise equipment based on a plurality of measurements of the user's body position and off-center movements collected by the COM sensor and the one or more additional sensors over time.

26 Claims, 11 Drawing Sheets

(52) U.S. Cl.
CPC ..... *A63B 2024/0025* (2013.01); *A63B 2024/0093* (2013.01); *A63B 2220/10* (2013.01); *A63B 2220/30* (2013.01); *A63B 2220/805* (2013.01); *A63B 2220/833* (2013.01)

(58) Field of Classification Search
CPC ..... A63B 2024/0093; A63B 2220/10; A63B 2220/30; A63B 2220/805; A63B 2220/833; A63B 22/0076; A63B 22/0605; A63B 22/0235; A63B 2220/56; A63B 2225/50
See application file for complete search history.

(56) References Cited

U.S. PATENT DOCUMENTS

| | | | | |
|---|---|---|---|---|
| 11,185,740 | B2 * | 11/2021 | Denton | A63B 22/025 |
| 11,995,725 | B2 * | 5/2024 | Pyles | G16H 40/63 |
| 2009/0023556 | A1 | 1/2009 | Daly et al. | |
| 2009/0036272 | A1 | 2/2009 | Yoo | |
| 2009/0197743 | A1 | 8/2009 | Schmidt | |
| 2009/0215588 | A1 | 8/2009 | Riener et al. | |
| 2013/0178958 | A1 | 7/2013 | Kulach et al. | |
| 2013/0225369 | A1 * | 8/2013 | Fisbein | A63B 71/0622 482/1 |
| 2013/0274063 | A1 | 10/2013 | Tyger et al. | |
| 2016/0007885 | A1 * | 1/2016 | Basta | A61B 5/112 600/595 |
| 2016/0023049 | A1 * | 1/2016 | Dalebout | A63B 22/0242 482/7 |
| 2016/0375339 | A1 * | 12/2016 | Lee | A63B 71/0054 482/7 |
| 2017/0113096 | A1 * | 4/2017 | Yu | G06F 3/067 |
| 2017/0128784 | A1 * | 5/2017 | Molins | A63B 23/0405 |
| 2017/0225038 | A1 * | 8/2017 | Wei | A63B 22/0242 |
| 2018/0117419 | A1 * | 5/2018 | Jackson | A63B 71/0622 |
| 2019/0216669 | A1 * | 7/2019 | Fukunaga | A63B 21/00181 |
| 2024/0238642 | A1 * | 7/2024 | Liriano | A63B 22/025 |

OTHER PUBLICATIONS

Wikipedia, "Communications Specification for Fitness Equipment," retrieved from https://en.wikipedia.org/wiki/Communications_Specification_for_Fitness_Equipment on Sep. 24, 2017; 3 pages.
International Search Report and Written Opinion mailed on Sep. 14, 2022 for International Application No. PCT/US2022/034914.

* cited by examiner

LS= LEFT SHANK
RS= RIGHT SHANK
COM= CENTER OF MASS

ALGORITHM CONTROL "DIALS"

| | DIAL | Comments |
|---|---|---|
| Optical sensor control | comScalar | center of mass optical sensor modification |
| | leftScalar | left optical sensor weighting factor |
| | rightScalar | right optical sensor weighting factor |
| Front distance | rocSpeedScalar | automated rate of change to increase slowing down rate going at faster speeds |
| | upperBand | close limit for speed up |
| | lowerBand | far limit for slow down |
| Speed control | maxSpeed | maximum cap treadmill will stop increasing speed |
| | minSpeed | machine starts at this speed |
| Back distance | lowerOSDist | L/R shank sensor, distance to back of belt |
| | upperOSDist | COM sensor, distance to back of belt |

FIG.4A

| Speed | Mode | Fidelity |
|---|---|---|
| 0.0-3.2 kph / 0-2 mph | Rehabilitation | High |
| 3.2-6.4 kph / 2-4 mph | Walking | Low |
| 6.4-9.7 kph / 4-6 mph | Jogging | Medium |
| 9.7-16 kph / 6-10 mph | Running | Medium |
| 16+ kph / 10+ mph | Sprinting | High |

FIG.4B

INDOOR ROWING MACHINE
Monitor Relative User:
- Chest position, acceleration
- Handle position, acceleration
- Seat position acceleration UPRIGHT CYCLING
Monitor Relative User:
- Chest position, acceleration
- Knee position, acceleration

SYSTEM FOR CONTROLLING EXERCISE EQUIPMENT BASED ON USER PACE AND MOTION ANALYSIS

CROSS-REFERENCE TO RELATED APPLICATIONS

The present application claims priority under 35 U.S.C. § 119(e) to U.S. Provisional Application Ser. No. 63/214,430, filed Jun. 24, 2021, and titled "System for Controlling Exercise Equipment Based on User Pace and Motion Analysis," which is incorporated herein by reference in its entirety.

STATEMENT OF GOVERNMENT SUPPORT

This invention was made with U.S. government support under grant number UT2 GM130175 awarded by the National Institutes of Health (NIH). The U.S. government has certain rights in the invention.

TECHNICAL FIELD

The present invention generally relates to equipment for exercise, rehabilitation, athletic performance or sports training, and the like, and more specifically relates to control systems for said equipment.

BACKGROUND

Speed and other operational parameters of a conventional piece of exercise equipment, such as a treadmill, are typically manually set by a user. If the user wishes to change any of these parameters during operation, the user must manipulate a keypad or other touch interface to make the change.

There is a demonstrable need for self-pacing exercise equipment to bring improvements in safety, to accommodate users with disabilities (e.g., uneven gait), and to enhance the user experience overall. There have been some previous attempts to making self-pacing treadmills; however, the existing systems lack a fundamental grounding in biomechanics and are unable to properly adjust for the dynamic pace and motion of each individual user.

SUMMARY

A system for controlling exercise equipment based on user pace and motion analysis is disclosed. The system includes a control unit communicatively coupled with a center of mass (COM) sensor and one or more additional sensors. The COM sensor is configured to track a position of a body of a user on the exercise equipment over time. The one or more additional sensors are configured to track off-center movements of the user over time. The control unit is configured to modulate an adjustable parameter of the exercise equipment based on a plurality of measurements of the user's body position and off-center movements collected by the COM sensor and the one or more additional sensors over time.

In some embodiments, the system is specifically configured to control a treadmill. For example, the system may include: a first time-of-flight (TOF) sensor configured to track a position of a body of a user on the treadmill over time; a second TOF sensor configured to track a position of a left leg of the user on the treadmill over time; a third TOF sensor configured to track a position of a right leg of the user on the treadmill over time; and a control unit configured to modulate a speed of the treadmill based on measurements from the first, second, and third TOF sensors.

A method of controlling exercise equipment is also disclosed. The method may include the steps of: tracking a position of a body of a user on the exercise equipment over time with a COM sensor coupled to or embedded within the exercise equipment; tracking off-center movements of the user over time with one or more additional sensors coupled to or embedded within the exercise equipment; and modulating an adjustable parameter of the exercise equipment, with a control unit coupled to or embedded within the exercise equipment, based on a plurality of measurements of the user's body position and off-center movements collected by the COM sensor and the one or more additional sensors over time.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

FIG. 4A is a table of scalar values (sometimes referred to herein as "algorithm control dials," "control dials" or simply "dials") that can be manually or automatically adjusted to tune the system, in accordance with one or more embodiments of this disclosure.

FIG. 4B is a table of example speed ranges that can be used to automatically place the system into different modes, wherein each of the different modes may have a respectively tuned set of algorithm control dials, in accordance with one or more embodiments of this disclosure.

DETAILED DESCRIPTION

The present disclosure is directed to a system 100 for controlling exercise equipment based on user pace and motion analysis. For example, the system 100 may be configured to control exercise equipment, including but not limited to a treadmill, based on user pace and motion (e.g., gait) analysis. In some embodiments, the system 100 utilizes a motion-capture free sensor system to identify gait, position, and limb (e.g., leg) swing. Using an algorithm to assess exercise equipment (e.g., treadmill) speed, on a moment by moment basis, the invention adjusts equipment speed based upon limb speed, user position, and other factors. The system 100 effectively enables automated, real-time responsive, self-pacing exercise equipment. The system 100 may also improve exercise equipment safety by providing an automatic shut-off feature when the operator is not using the equipment appropriately or when external motion is detected in proximity to moving mechanical parts.

FIGS. 1A through 5 illustrate one or more embodiments of the system 100 configured for a self-pacing treadmill 200. Previous attempts at self-pacing treadmills lacked a fundamental grounding in biomechanics. But by using a novel sensor arrangement and algorithm, the system 100 enables real-time responsive self-pacing. The system 100 allows the treadmill 200 to automatically adjust to running speed at a rate faster than the belt can modify. This allows the treadmill 200 to operate entirely in a free self-pacing "glide" mode. The system 100 may also allow the treadmill 200 to detect when a user has fallen or is otherwise unable to run and automatically shut-off via a "belt arrest" feature.

Figure 1A:
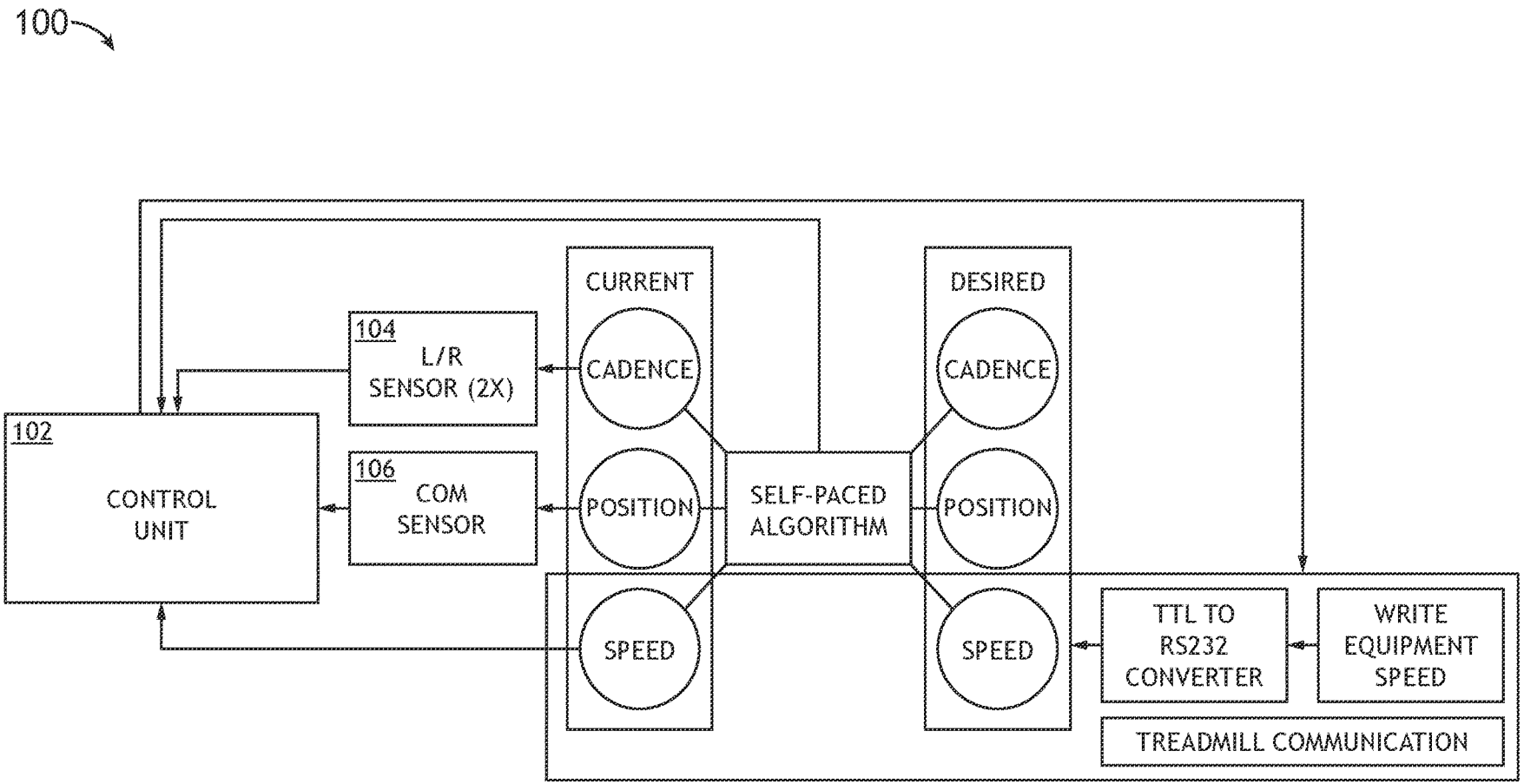
FIG. 1A is a block diagram illustrating a system for controlling exercise equipment based on user pace and motion analysis, in accordance with one or more embodiments of this disclosure.

FIG. 1A illustrates the system 100 for controlling exercise equipment based on user pace and motion analysis, in accordance with one or more embodiments of this disclosure. The system 100 includes a control unit 102. The system 100 further includes a center of mass (COM) sensor 106 and one or more off-center sensors 104 that are communicatively coupled to the control unit 102. For example, the COM sensor 106 and the one or more off-center sensors 104 may be physically connected (e.g., wired) to the control unit 102 and/or wirelessly connected (e.g., via WiFi, WLAN, Bluetooth, NFC, RF communication protocols, optical communication protocols, or the like).

In some embodiments, the COM sensor 106 and the one or more off-center sensors 104 are time-of-flight (TOF) sensors, such as but not limited to: optical sensors (e.g., infrared sensors, Lidar sensors, etc.), radar sensors, or hybrid sensors. In a treadmill implementation, for example, the system 100 may include: a first TOF sensor (i.e., the COM sensor 106) configured to track a position of a body of a user on the treadmill over time; a second TOF sensor (i.e., left-side/left-shank off-center sensor 104) configured to track a position of a left leg of the user on the treadmill over time; and a third TOF sensor (i.e., right-side/right-shank off-center sensor 104) configured to track a position of a right leg of the user on the treadmill over time. As discussed in more detail below, the control unit 102 may be configured to modulate a speed of the treadmill based on measurements from the first, second, and third TOF sensors.

Figure 1B:
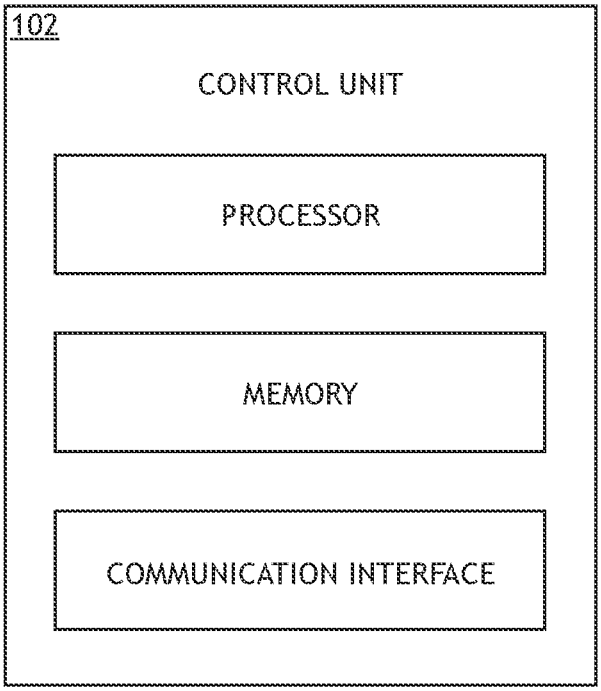
FIG. 1B is a block diagram illustrating a control unit for the system, in accordance with one or more embodiments of this disclosure.

Referring now to FIG. 1B, the control unit 102 may include a processor, memory, and communication interface.

The processor provides processing functionality for at least the control unit 102 and can include any number of processors, microprocessors, microcontrollers, circuitry, field programmable gate array (FPGA) or other processing systems and resident or external memory for storing data, executable code and other information accessed or generated by the control unit 102. The processor can execute one or more software programs embodied in a non-transitory computer readable medium (e.g., memory) that implement techniques/operations described herein. The processor is not limited by the materials from which it is formed, or the processing mechanisms employed therein and, as such, can be implemented via semiconductor(s) and/or transistors (e.g., using electronic integrated circuit (IC) components), and so forth.

The memory can be an example of tangible, computer-readable storage medium that provides storage functionality to store various data and/or program code associated with operation of the control unit 102/processor, such as software programs and/or code segments, or other data to instruct the processor, and possibly other components of the control unit 102, to perform the functionality described herein. Thus, the memory can store data, such as a program of instructions for operating the control unit 102, including its components (e.g., processor, communication interface, etc.), and so forth. It should be noted that while a single memory is described, a wide variety of types and combinations of memory (e.g., tangible, non-transitory memory) can be employed. The memory can be integral with the processor, can comprise stand-alone memory, or can be a combination of both. Some examples of the memory can include removable and non-removable memory components, such as random-access memory (RAM), read-only memory (ROM), flash memory (e.g., a secure digital (SD) memory card, a mini-SD memory card and/or a micro-SD memory card), solid-state drive (SSD) memory, magnetic memory, optical memory, universal serial bus (USB) memory devices, hard disk memory, external memory, or the like.

The communication interface can be operatively configured to communicate with components of the control unit 102. For example, the communication interface can be configured to retrieve data from the processor or other devices (e.g., sensors 104, 106, 108, and/or 110, treadmill 200, etc.), transmit data for storage in the memory, retrieve data from storage in the memory, and so forth. The communication interface can also be communicatively coupled with the processor to facilitate data transfer between components of the control unit 102 and the processor. It should be noted that while the communication interface is described as a component of the control unit 102, one or more components of the communication interface can be implemented as external components communicatively coupled to the control unit 102 via a wired and/or wireless connection. The control unit 102 can also include and/or connect to one or more input/output (I/O) devices (e.g., via the communication interface), such as an input device (e.g., a trackpad, a touchpad, a touchscreen, a keyboard, a keypad, a microphone (e.g., for voice commands), etc.) and/or an output device (e.g., a display, a speaker, a tactile feedback device, etc.). In embodiments, the communication interface may also include or may be coupled with a transmitter, receiver, transceiver, physical connection interface, or any combination thereof.

It shall be understood that any of the functions, steps or operations described herein are not necessarily all performed by one control unit 102. In some embodiments, various functions, steps, or operations may be performed by one or more control units 102. For example, one or more operations and/or sub-operations may be performed by a first control unit, additional operations and/or sub-operations may be performed by a second control unit, and so forth. Furthermore, some of the operations and/or sub-operations may be performed in parallel and not necessarily in the order that they are disclosed herein.

Figure 2A:
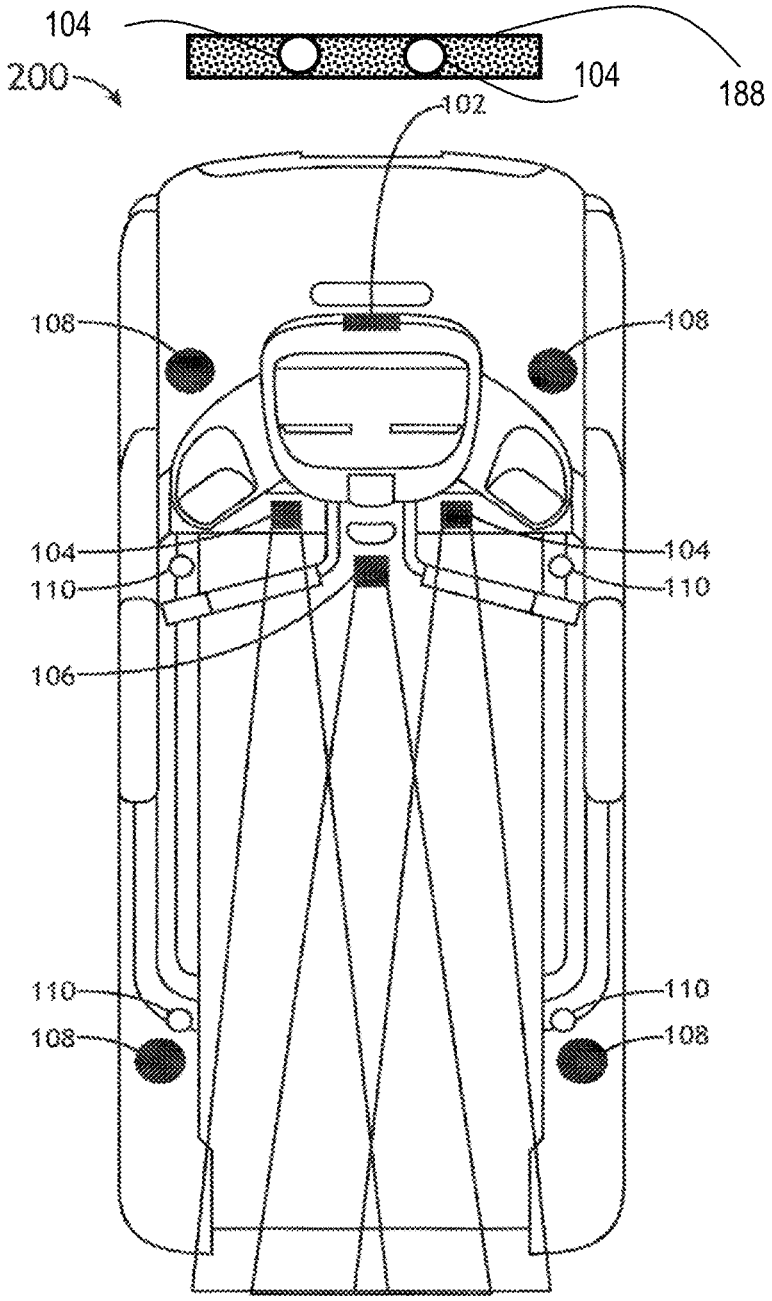
FIG. 2A is a top plan view schematic illustration of a treadmill equipped with the system, in accordance with one or more embodiments of this disclosure.
Figure 2B:
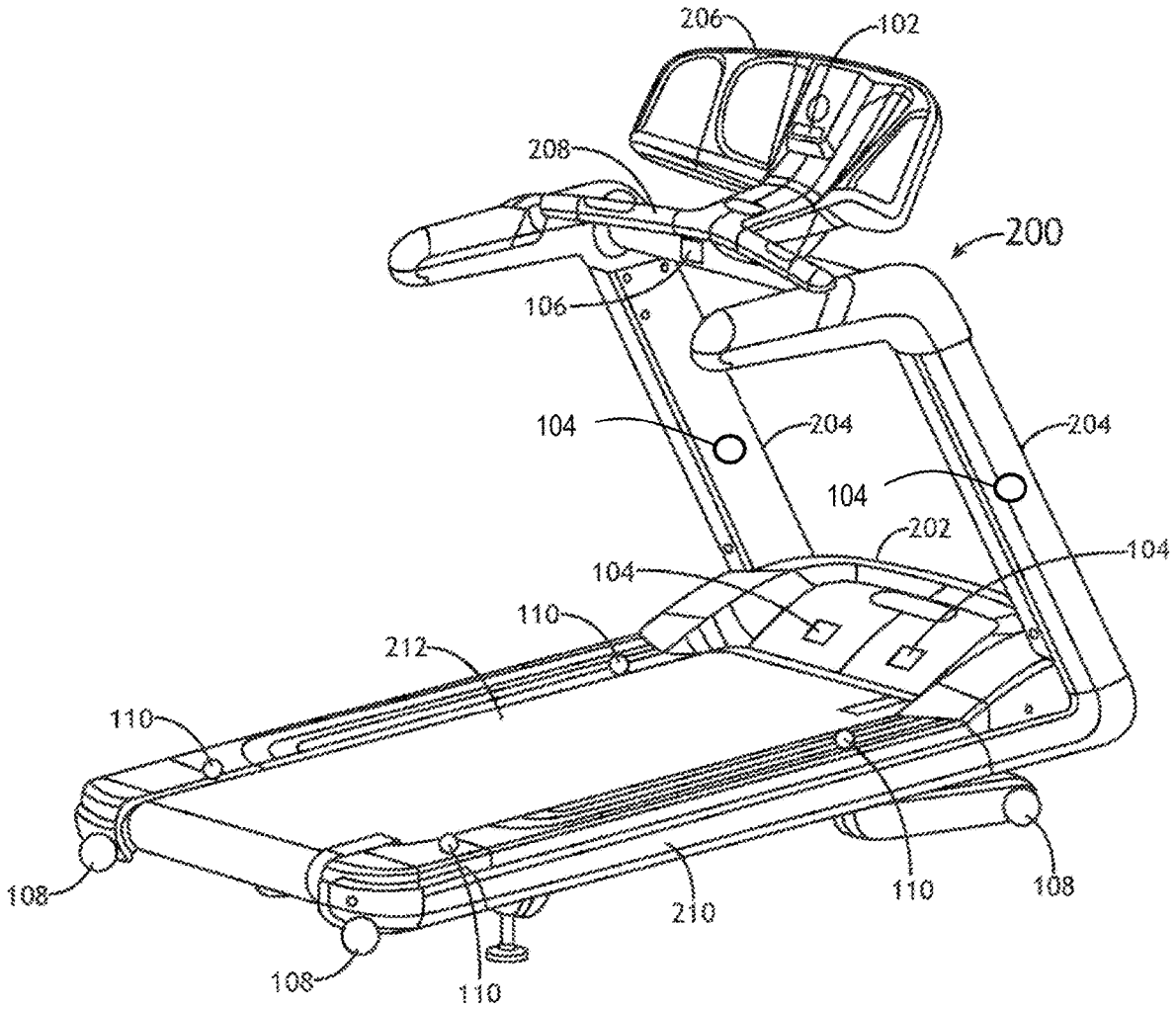
FIG. 2B is a top plan view schematic illustration of a treadmill equipped with the system, in accordance with one or more embodiments of this disclosure.

FIGS. 2A and 2B illustrate a treadmill 200 equipped with the system 100, in accordance with one or more embodiments of this disclosure. As shown in FIG. 2B, the treadmill 200 may include a motor housing 202 (with a belt motor disposed therein), upright supports 204 on either side of the motor housing 202, a central console 206 (with treadmill user interface components) upheld by the upright supports 204, optionally a handle bar 208 on or coupled to the central console, a platform 210 (optionally adjustable to provide an incline), and a motor-driven belt 212 that moves across the platform 210 at a selected speed.

In embodiments, the control unit 102 may be within the central console 202 of the treadmill 200. Alternatively, the control unit 102 may be externally coupled to the central console 202 or integrated within or coupled to another portion of the treadmill 200. The control unit 202 may be configured to communicate with the treadmill 200 via a CSAFE communication interface of the treadmill 200 or any other appropriate communication protocol.

As shown in FIG. 2A, the COM sensor 106 may be centrally located while the off-center (left-side/left-shank and right-side/right-shank) sensors 104 are disposed on either side of the COM sensor 106. For example, the COM sensor 106 may be coupled to or integrated within the central console 206, coupled to or integrated within a central portion of the motor housing 202, or any similar location on the treadmill 200. Meanwhile, the off-center (left-side/left-shank and right-side/right-shank) sensors 104 may be coupled to or integrated within left and right side portions of the motor housing 202, the left-side and right-side upright supports 204, or any similar location on the treadmill 200. Alternatively, any of the sensors may be coupled to a stand that is located near the treadmill 200. For example, the COM sensor 106 may alternatively be coupled to a stand disposed in front of the treadmill 200 and substantially aligned with a central axis of the treadmill. By way of further example, the off-center (left-side/left-shank and right-side/right-shank) sensors 104 may be coupled to one or more stands disposed in front of the treadmill 200 and located on either side of the central axis of the treadmill 200. In preferred embodiments, the COM sensor 106 may be disposed at a higher elevation than the off-center (left-side/left-shank and right-side/right-shank) sensors 104.

The control unit 102 is configured to modulate the speed of the treadmill based on the measurements from the COM sensor 106 and the off-center (left-side/left-shank and right-side/right-shank) sensors 104. For example, the control unit 102 may be configured to: collect multiple sets of sensor measurements for the position of the body of the user, the position of the left leg of the user, and the position of the right leg of the user on the treadmill at multiple points in time; calculate differences between heel strike measurements in a first set of sensor measurements for a first point in time and heel strike measurements in a second set of sensor measurements for a second point in time; and adjust the speed of the treadmill based on the differences between the heel strike measurements at the first and second points in time.

The system 100 may be configured to account for user disabilities (e.g., uneven gait). For example, in some embodiments, the control unit 102 is configured to adjust the speed of the treadmill based on the differences between the heel strike measurements at the first and second points in time by reducing the speed of the treadmill to conform to a difference between heel strike measurements of the user's slowest leg. In further embodiments, the control unit 102 is configured to adjust the speed of the treadmill based on the differences between the heel strike measurements at the first and second points in time by: (i) reducing the speed of the treadmill to conform to a difference between heel strike measurements of the user's slowest leg for a first time frame corresponding to a full step of the slowest leg of the user; and then (ii) increasing the speed of the treadmill to conform to a difference between heel strike measurements of user's fastest leg for a second time frame corresponding to a full step of the fastest leg of the user. The control unit 102 may be configured to repeat (i) and (ii) until detecting a change in differences between heel strike measurements at subsequent points in time.

In some embodiments, the control unit 102 may be configured to assign weights to the measurements from the COM sensor 106 and the off-center (left-side/left-shank and right-side/right-shank) sensors 104 based on treadmill specifications, user-input data associated with the user (e.g., height, weight, age, physiological information, average performance parameters, target performance parameters, etc.), and/or previously collected sensor measurements. The control unit 102 may additionally/alternatively be configured to assign weights to the sensor measurements to compensate for a non-responsive sensor (e.g., when the COM sensor 106 or one of the off-center sensors 104 is determined to be non-responsive or providing out-of-range data, most likely due to malfunction).

In some embodiments, the system 100 may further include force/pressure sensors configured to assist the off-center sensors 104 with detection of heel strikes, or to assist with calibration by measuring the user's weight and/or the amount of force that the user exerts on the treadmill 200 while running/walking. For example, the system 100 may include load cells 108, force sensing resistors 110, or other types of force/pressure sensors configured to detect force/pressure exerted on the platform 210 and/or belt 212. In some embodiments, the control unit 102 may be configured to assign weights to measurements from sensors 104 and/or 106 based on force, pressure, and/or impact data collected via sensors 108 and/or 110.

In addition to controlling the treadmill 200 based on user pace and motion analysis, the control unit 102 may be further configured to provide long term user analytics or session analytics based on recorded sensor measurements and logged treadmill speed over time. For example, the control unit 102 may be configured to record and/or report various metrics such as, but not limited to, average speed, highest speed, lowest speed, step counts, gait performance, left leg performance, right leg performance, and the like.

Figure 2C:
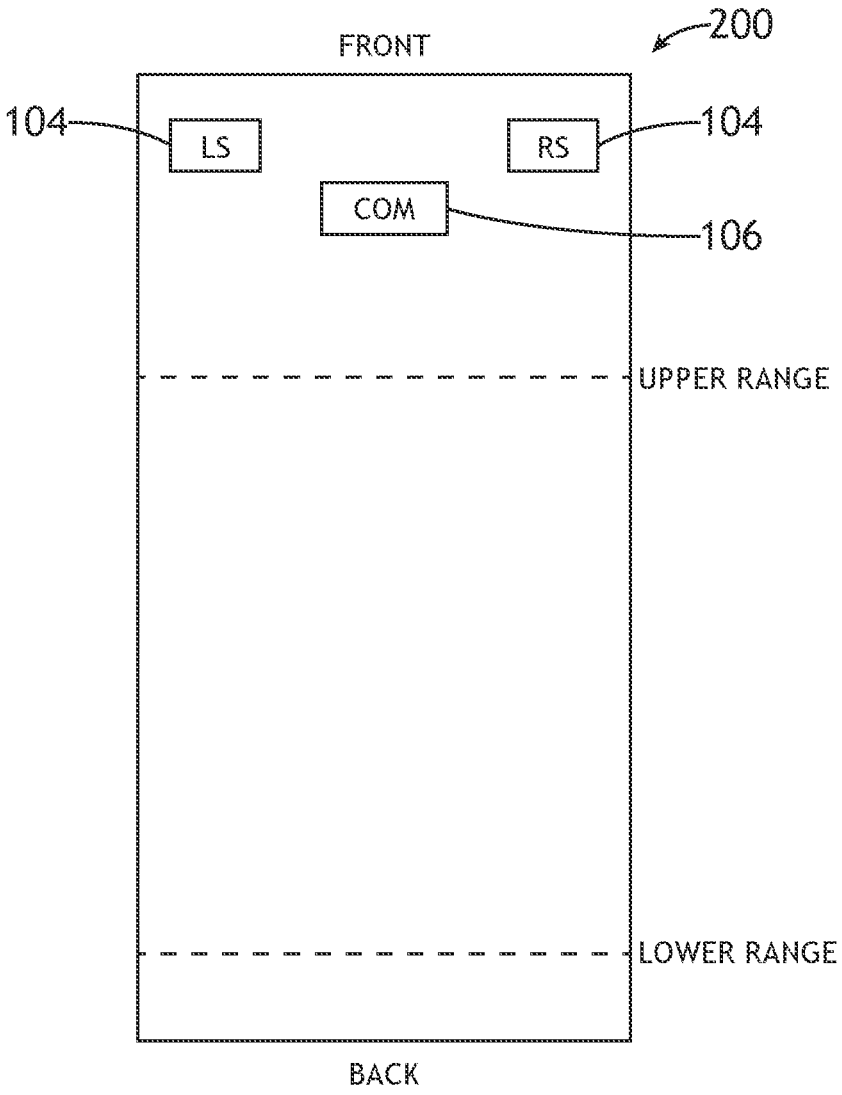
FIG. 2C is a simplified schematic illustration of three time-of-flight (TOF) sensors of the system placed on a treadmill with designated upper range and lower range boundaries, in accordance with one or more embodiments of this disclosure.

The COM sensor 106 and the off-center (left-side/left-shank and right-side/right-shank) sensors 104 may be further configured to detect whether the user in within a predefined zone on the treadmill 200 (e.g., between the lower range and upper range boundary lines in FIG. 2C). For example, the control unit 102 may be configured to slow down the treadmill 200 regardless of limb movement when the user crosses the lower range boundary line. Similarly, the control unit 102 may be configured to speed up the treadmill 200 regardless of limb movement when the user crosses the upper range boundary line. In this regard, the control unit 200 may give priority to measurements of the user's body position collected by the COM sensor 106. For example, the control unit 102 may be configured to adjust the speed of the treadmill 200 based on measurements collected by the COM sensor 106 regardless of measurements collected by the off-center (left-side/left-shank and right-side/right-shank) sensors 104 when the body of the user is not within the predefined zone on the treadmill 200 for a certain amount of time.

Figure 3A:
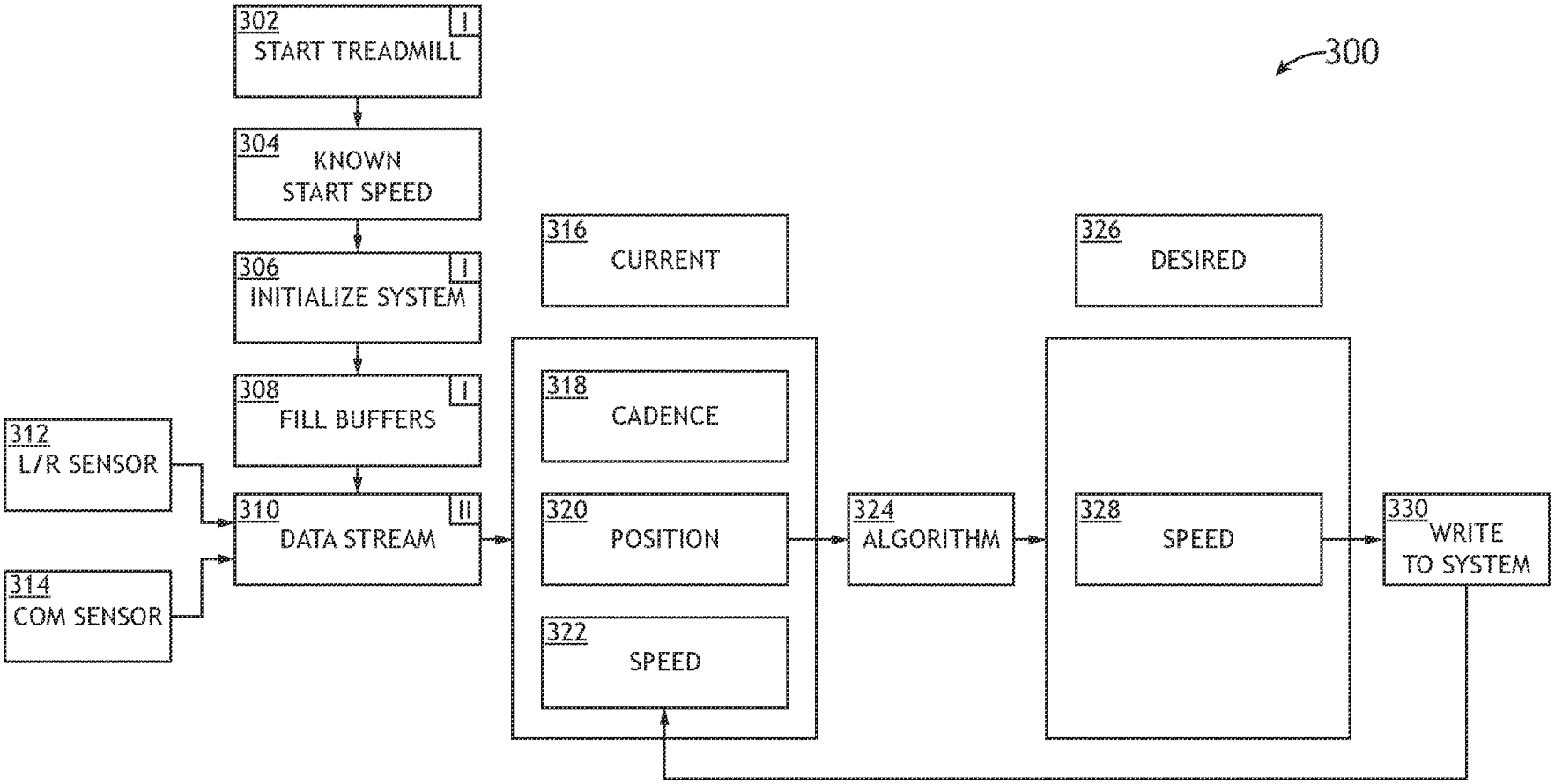
FIG. 3A is a flow diagram illustrating a method of controlling exercise equipment based on user pace and motion analysis, in accordance with one or more embodiments of this disclosure.

FIG. 3A is a flow diagram illustrating a method 300 of controlling the treadmill 200 with system 100. The system 100 may be configured to perform any of the following steps/operations, and the method 300 may include any steps/operations disclosed or implied by any of the embodiments of the system 100 described herein.

In embodiments, the system 100 engages in a feedback loop to regulate the speed of the treadmill 200 constantly. Starting with the instant speed of the belt 212, the control unit 102 is configured to initiate communication with the treadmill 200 (e.g., via C-SAFE) to determine the sensor input and the user's position and leg speed (blocks 302-308). One set of sensors (e.g., COM sensor 106) measures the position of the user on the belt 212 of the treadmill 200, and another set of sensors (e.g., off-center (left-side/left-shank and right-side/right-shank) sensors 104) can measure the location of each of the user's feet—based on their gait cycle (blocks 310-314). The sensor data may integrate into the treadmill through the C-SAFE portal or any other appropriate communication interface.

The integration of the sensor data allows the system 100 to calibrate, over time, to determine if the system 100 needs to accelerate the belt to accommodate the instant pace of the user. By using multiple sensors, the system 100 can fill buffers where signal from one sensor is unable to meaningfully measure the location of the user on the treadmill 200. For example, if a sensor loses the location of one of the user's feet, it can simply weight the data from the user's visible foot.

Figure 3B:
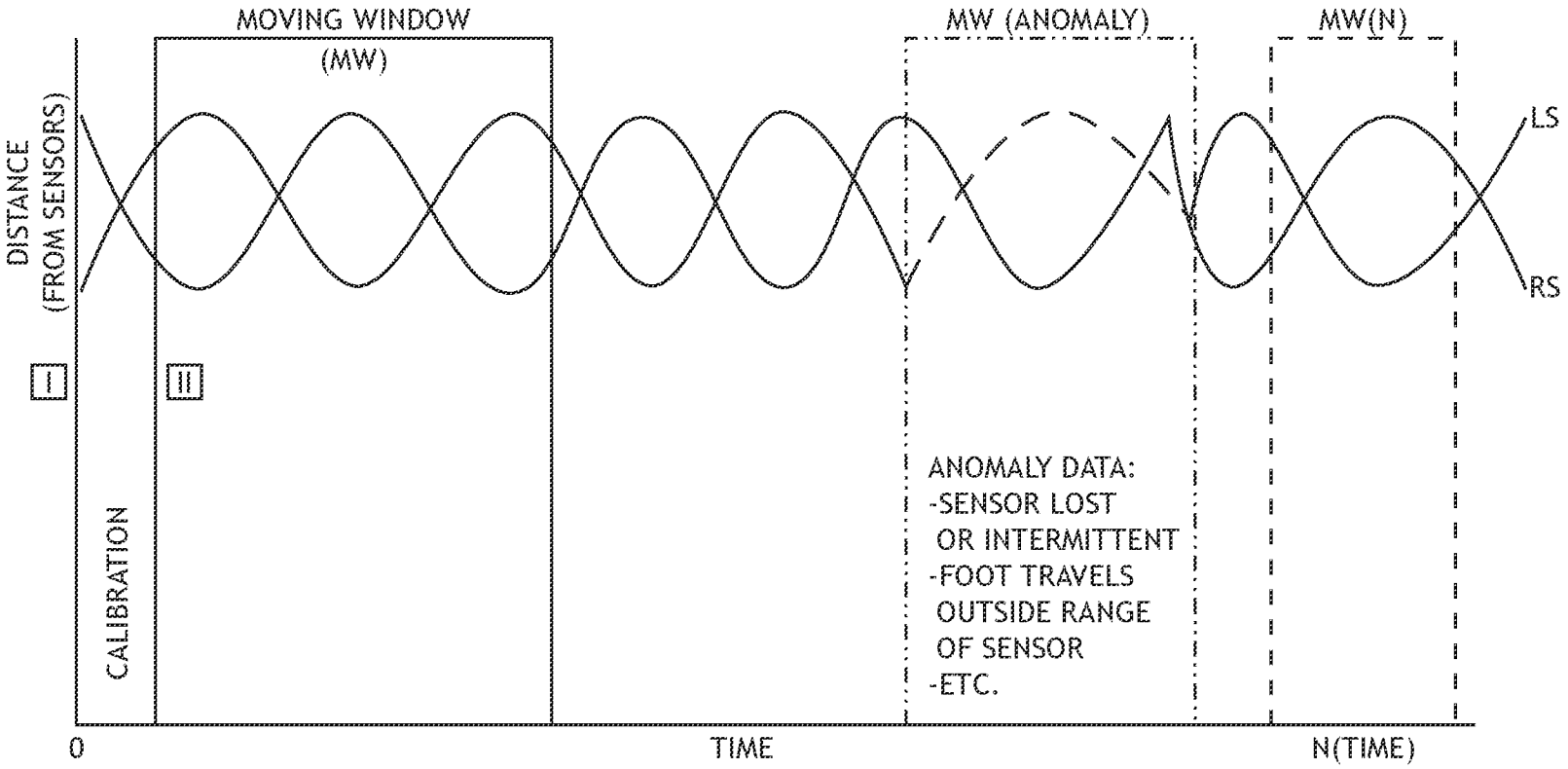
FIG. 3B is a graphical depiction associated with user pace and motion analysis data processing performed in the method of FIG. 3A, in accordance with one or more embodiments of this disclosure.

In the foregoing manner, the system 100 creates ongoing frames (MW) wherein it can compare the biomechanics of the user and the instant speed of the user (blocks 316-322, also see FIG. 3B). The size and specificity of the frame is a function of the frequency of the sensors, the speed of the belt and the control of the belt.

With the buffered information and the operation of the treadmill, the control unit 102 is ready to apply an algorithm in order assess if the system 100 needs to adjust the belt speed (block 324). The algorithm uses the distance values from the sensors and weights them dynamically based upon the fill buffers. In addition, the sensors identify the change in heel strikes—the location of where the user's feet are falling on the treadmill belt 212—to position the user on the known length of the belt 212. Integrating that positional data relative to the pre-defined limits, the algorithm dictates real time speed changes of the belt based on the user's biomechanics (blocks 326-330).

The control unit 102 then closes the frame and starts over. Beginning with the instant speed of the treadmill the system then measures the position of the user.

The algorithm executed by the control unit 102 focuses on what the user is doing "now" and then "next". These "windows" of data allow the algorithm to capture and then continually adjust to the next conditions. In this implementation, the system 100 employs a feed-forward solution and the data windowing provides the feedback loop. For each step, the algorithm checks for that step and the corresponding center of mass reading, then it makes a decision, and it continuously repeats the loop.

Other systems have tried to overcome similar operating challenges by monitoring and controlling a continuous stream of data, but this is too reactive, and the system becomes unstable—the user is not part of the system because there is too much instantaneous feedback in a continuous stream of data approach.

In embodiments of the disclosed system 100, the control unit 102 executes the self-pacing algorithm. The control unit 102 reads the user's current cadence, position, and speed through the sensor system (sensors 104, 106, etc.) that detect the left and right shank swing as well as the user's center of mass. The control unit 102 then compares these readings against the desired cadence, position, and speed and sends the corresponding speed update signals to the treadmill 200 as needed.

Referring now to FIG. 3B, at the beginning of each user workout, the algorithm causes the control unit 102 to determine the user speed [I], and then initiate data gathering [II] and calibration [II] to fill the necessary data buffers. These data buffers create the "windows" upon which the algorithm is built. The algorithm then causes the control unit 102 to: read the optical sensor distance values; weight values dynamically based off data integrity; calculate delta on heel strikes; and run calculations to get new user speed. In embodiments, multiple sets of sensor measurements are temporarily stored within a measurement window for processing by the control unit 102, and the measurement window is continuously being updated by deleting an oldest set of sensor measurements and adding a newest set of sensor measurements.

This main loop comprises the data gathering subsystem. The data window (moving window, MW) is sliding through time and is typically 2-3 gait cycles. Change in distance and change in time over a few steps are used to prime the system. Variables in the algorithm are used to hold the information for continuous analysis. Algorithm control dials are the primary control variables. As shown in FIG. 4A, these "dials" are adjustable scalar values used as weighting factors for the measurements. The algorithm control dials are adjustable to modify the measurement window or an interpretation of the sensor measurements by the control unit 102. For example, the algorithm control dials may include, but are not limited to, any combination of the following: Optical sensor controls: "comScalar"—center of mass optical sensor modification; "leftScalar"—left optical sensor weighting factor; and/or "rightScalar"—right optical sensor weighting factor; Front distance controls: "rocSpeedScalar"—automated rate of change to increase slowing down rate going at faster speeds; "upperBand"—close limit for speed up; and/or "lowerBand"—far limit for slow down; Speed controls: "maxSpeed"—maximum cap treadmill will stop increasing speed; and/or "misSpeed"—machine starts at this speed; and/or Back distance controls: "lowerOSDist"—L/R shank sensor, distance to back of belt; and/or "upperOSDist"—COM sensor, distance to back of belt.

In some embodiments, the moving windows (MW) can then be adjusted wider or narrower (e.g., MW(n)), allowing the algorithm to better assess stride-to-stride variance without overdamping or underdamping the next positions. The main loop continually performs input capture, processing the data (filling windows, filtering and smoothing the data), and output adjustments. This "time history of movement" represents an improved dynamic system model for user feedback and system adjustment.

It is further contemplated that several sub-window concepts could be created, for example, to account for specifics and nuances in commercial versus consumer, performance, rehabilitation, and other use cases, creating infinite opportunities to fine tune the dials required for the different control approaches.

In an example operational scenario, the control unit 102 may be configured to fill the window (MW) when the user starts walking on the treadmill 200. When enough data is acquired to make an adjustment, the algorithm does so based off the cadence provided by the lower sensors (sensors 104) and the Center of Mass by the upper sensor (sensor 106). The window (MW) is always refreshed with new data and only keeps as much data as needed (set by the dials) to allow the algorithm to detect changes in cadence.

In some embodiments, the system 100 only requires the last two peaks and calculates a change between them. Data smoothing and corrections happen within the algorithm and only affect change to improve data being acted upon to allow a better choice when making/feeding the treadmill changes.

User safety is inherent in the system 100 because the algorithm can feed directly into the existing treadmill speed controls, not around nor outside of them. Furthermore, the existing treadmill safety mechanisms and standards are still in place, including the safety lanyards. As such, the algorithm can adhere to and improve upon all the safety standards currently designed into the treadmill.

Robustness is also inherent in the system. Due to the scalar "dials," the measurement weights can be adjusted if any one of the existing optical sensors becomes momentarily or permanently disabled. Similarly, with the ranges already defined for detecting peaks and falls in the data windows, any data that is significantly different (e.g., MW (anomaly)) can be ignored and not responded to. The algorithm is designed to assume the data is imperfect—it could be a shin reading, then a foot, then an ankle—but all the data is considered to create a curve for the window to assess.

In embodiments, the algorithm also includes "minChange" and "maxChange" variables to prevent hard stops. The algorithm does not adjust the treadmill speed until it has completed a window. This smoothing helps prevent unexpected rapid acceleration and deceleration. The algorithm control dials can also be tuned to model falling, and then be adjusted to prevent the user from falling accordingly.

In embodiments, the control unit 102 is also configured to adapt the system 100 to different modes (e.g., rehabilitation, walking, jogging, running, sprinting, etc.). For example, FIG. 4B is a table of example speed ranges that can be used to automatically place the system 100 into different modes, wherein each of the different modes may have a respectively tuned set of algorithm control dials. When the control unit 102 detects (via sensors 104 and/or 106) that the user changes from a first speed range (e.g., walking speed) to another speed range (e.g., running speed) and remains in that range for a threshold amount of time (e.g., 1 second, 2 seconds, . . . 5 seconds, etc.), the control unit 102 may be configured to transition the system 100 from its current mode to the new mode (e.g., from walking mode to running mode) and automatically adjust the algorithm control dials accordingly. Additionally, the control unit 102 may be further configured to adapt the system 100 to different modes based on detected or user-input athletic performance scenarios, goals, user profiles, etc. For example, the control unit 102 may be configured to adapt the system 100 to different algorithm control dial settings for a cross country training mode vs. a sprinter training mode, and so forth.

Figure 5:
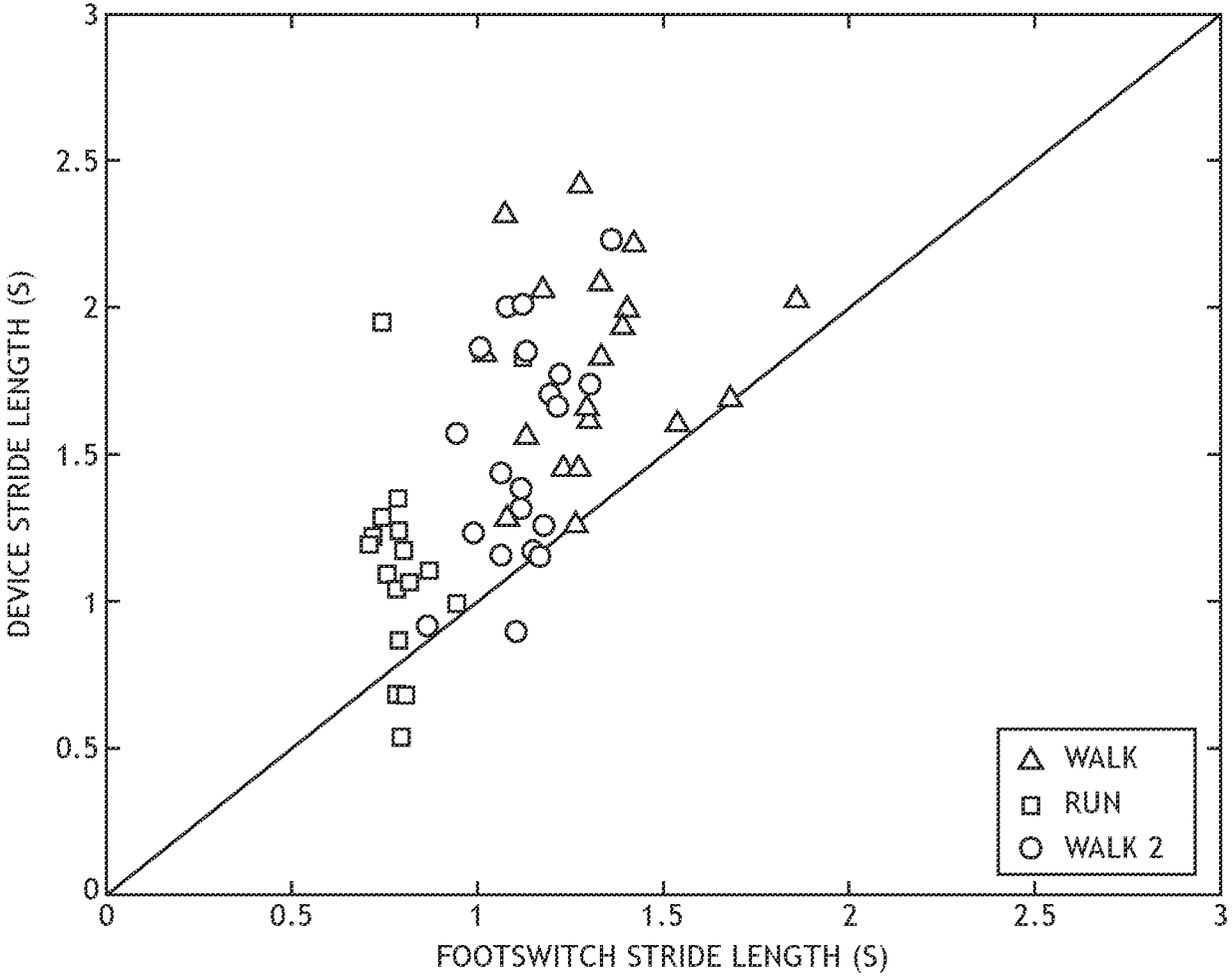
FIG. 5 is a correlation plot showing agreement between stride times detected by the system's TOF sensors and stride times detected by footswitches.

Studies have compared stride times calculated by the system 100 to stride times calculated using foot switches. FIG. 5 is a correlation plot showing agreement between stride times detected by the system's TOF sensors and stride times detected by footswitches. People and their strides are inherently variable. The system 100 interprets and adjusts to meet this variability.

Figure 6A:
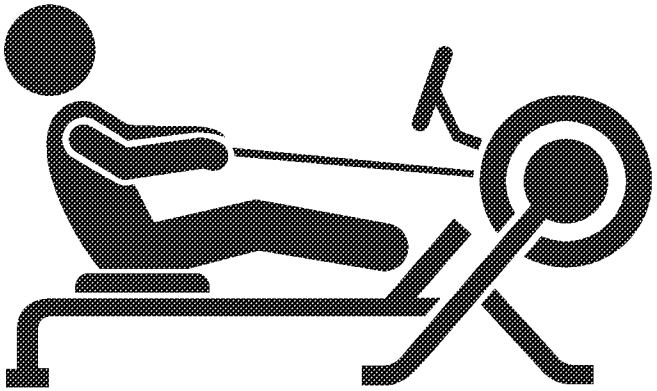
FIG. 6A illustrates an example of another type of exercise equipment (rowing machine) that may incorporate the system, in accordance with one or more embodiments of this disclosure.
Figure 6B:
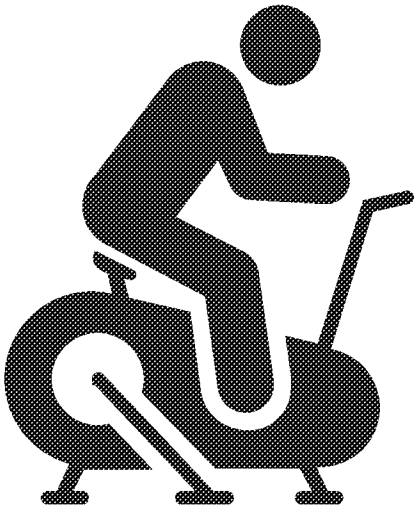
FIG. 6B illustrates an example of another type of exercise equipment (cycling machine) that may incorporate the system, in accordance with one or more embodiments of this disclosure.

As previously noted, the system 100 may be configured for other types of exercise equipment or modalities. For example, FIG. 6A illustrates an example of another type of exercise equipment (a rowing machine) that may incorporate the system 100, wherein the COM sensor 106 is configured to track a position of the user's body (e.g., chest position, acceleration, etc.) over time and one or more off-center sensors 104 are configured to track off-center limb or body movements (e.g., handle position, acceleration, etc. and/or seat position, acceleration, etc.) of the user over time. As another example, FIG. 6B illustrates an example of another type of exercise equipment (a cycling machine) that may incorporate the system 100, wherein the COM sensor 106 is configured to track a position of the user's body (e.g., chest position, acceleration, etc.) over time and one or more off-center sensors 104 are configured to track off-center limb or body movements (e.g., knee position, acceleration, etc.) of the user over time.

The system 100 may be configured for controlling any type of exercise equipment based on user pace and motion analysis, where the COM sensor 106 is configured to track a position of a body of a user on the exercise equipment over time, the one or more additional sensors (off-center sensors 104) are configured to track off-center movements of the user over time, and the control unit 102 is configured to modulate an adjustable parameter (e.g., speed, resistance, etc.) of the exercise equipment based on a plurality of measurements of the user's body position and off-center movements collected by the COM sensor and the one or more additional sensors over time.

Similarly, a method of controlling any type of exercise equipment may include the steps of: tracking a position of a body of a user on the exercise equipment over time with a COM sensor coupled to or embedded within the exercise equipment; tracking off-center movements of the user over time with one or more additional sensors coupled to or embedded within the exercise equipment; and modulating an adjustable parameter of the exercise equipment, with a control unit coupled to or embedded within the exercise equipment, based on a plurality of measurements of the user's body position and off-center movements collected by the COM sensor and the one or more additional sensors over time.

Furthermore, the system and/or method described above can further include means to provide analytics based on user performance and recorded equipment parameters. For example, the control unit 102 may be further configured to provide long term user analytics or session analytics based on recorded sensor measurements and logged equipment parameters over time. For example, the control unit 102 may be configured to record and/or report various metrics such as, but not limited to, average speed, highest speed, lowest speed, average resistance, lowest resistance, highest resistance, step counts, rpm, gait performance, left leg performance, right leg performance, and the like.

Although the technology has been described with reference to the embodiments illustrated in the attached drawing figures, equivalents may be employed, and substitutions may be made herein without departing from the scope of the technology as recited in the claims. Components illustrated and described herein are examples of devices and components that may be used to implement the embodiments of the present invention and may be replaced with other devices and components without departing from the scope of the invention. Furthermore, any dimensions, degrees, and/or numerical ranges provided herein are to be understood as non-limiting examples unless otherwise specified in the claims.

What is claimed is:

1. A system for controlling a treadmill, comprising:

a first time-of-flight (TOF) sensor configured to track a position of a body of a user on the treadmill over time;

a second TOF sensor configured to track a position of a left leg of the user on the treadmill over time;

a third TOF sensor configured to track a position of a right leg of the user on the treadmill over time; and a control unit configured to modulate a speed of the treadmill based on multiple sets of measurements for the position of the body of the user, the position of the left leg of the user, and the position of the right leg of the user on the treadmill at multiple points in time, wherein the multiple sets of measurements are determined based on sensor data from the first, second, and third TOF sensors, the multiple sets of the measurements processed by the control unit are stored within a moving measurement window, and the moving measurement window is updated by deleting an oldest set of the measurements and adding a newest set of sensor measurements.

2. The system of claim 1, wherein the control unit is configured to modulate the speed of the treadmill based on the measurements from the first, second, and third TOF sensors by:

calculating differences between heel strike measurements in a first set of sensor measurements for a first point in time in the moving measurement window and heel strike measurements in a second set of sensor measurements for a second point in time in the moving measurement window; and adjusting the speed of the treadmill based on the differences between the heel strike measurements at the first and second points in time.

3. The system of claim 2, wherein the control unit is configured to adjust the speed of the treadmill based on the differences between the heel strike measurements at the first and second points in time by reducing the speed of the treadmill to conform to a difference between heel strike measurements of a slowest leg of the user.

4. The system of claim 2, wherein the control unit is configured to adjust the speed of the treadmill based on the differences between the heel strike measurements at the first and second points in time by: (i) reducing the speed of the treadmill to conform to a difference between heel strike measurements of a slowest leg of the user for a first time frame corresponding to a full step of the slowest leg of the user; (ii) increasing the speed of the treadmill to conform to a difference between heel strike measurements of a fastest leg of the user for a second time frame corresponding to a full step of the fastest leg of the user; and repeating (i) and (ii) until detecting a change in differences between heel strike measurements at subsequent points in time.

5. The system of claim 1, wherein the control unit modulates the speed of the treadmill based on a set of one or more scalar weights applied to at least one or more of the first TOF sensor, the second TOF sensor, the third TOF sensor, a front distance of the user, a back distance of the user, and a speed control of the control unit.

6. The system of claim 5, wherein the control unit is further configured to:

detect based on the multiple sets of measurements in the moving measurement window that the user changes from a speed range to a further speed range and remains in the further speed range for a threshold amount of time; and based on the detection, modulate the speed of the treadmill based on a further set of scalar weights.

7. The system of claim 1, wherein the first TOF sensor is coupled to or integrated within a central console of the treadmill, or is coupled to or integrated within a central portion of a motor housing of the treadmill.

8. The system of claim 1, wherein the first TOF sensor is coupled to a stand disposed in front of the treadmill and substantially aligned with a central axis of the treadmill.

9. The system of claim 1, wherein the second and third TOF sensors are coupled to or integrated within left-side and right-side upright supports of the treadmill, or are coupled to or integrated within left and right side portions of a motor housing of the treadmill.

10. The system of claim 1, wherein the second and third TOF sensors are coupled to one or more stands disposed in front of the treadmill and are on either side of a central axis of the treadmill.

11. The system of claim 1, wherein the first TOF sensor is at a higher elevation than the second and third TOF sensors.

12. The system of claim 1, wherein the first, second, and third TOF sensors are optical sensors, wherein optical sensors include at least one or more of an infrared sensor and a lidar sensor.

13. The system of claim 1, wherein the first, second, and third TOF sensors are radar sensors.

14. The system of claim 1, wherein the control unit is configured to communicate with the treadmill via a CSAFE communication interface of the treadmill.

15. The system of claim 1, wherein the control unit is integrated within a central console of the treadmill.

16. The system of claim 1, wherein the control unit is configured to assign weights to the measurements from the first, second, and third TOF sensors based on at least one of: treadmill specifications, user-input data associated with the user, or previously collected sensor measurements.

17. The system of claim 1, wherein the control unit is configured to adjust the speed of the treadmill based on measurements collected by the first TOF sensor regardless of measurements collected by the second and third TOF sensors when the body of the user is not within a predefined zone on the treadmill for a certain amount of time.

18. The system of claim 1, wherein the control unit is configured to assign weights to the measurements from two responsive sensors of the first, second, and third TOF sensors to compensate for a non-responsive sensor of the first, second, and third TOF sensors when one of the first, second, and third TOF sensors is determined to be non-responsive.

19. The system of claim 1, wherein the control unit is further configured to provide long-term user analytics or session analytics based on recorded sensor measurements and logged treadmill speed over time.

20. The system of claim 1, wherein the moving measurement window includes multiple sets of measurements associated with two to three gait cycles of the user.

21. The system of claim 1, wherein a width of the moving measurement window widens or narrows over time in response to stride-to-stride variance.

22. The system of claim 1, wherein the moving measurement window includes multiple sets of measurements associated with a last two peaks only, and the control unit is further configured to modulate the speed of the treadmill by calculating a change between the last two peaks.

23. The system of claim 1, wherein one or more anomalous sets of measurements in the moving measurement window are ignored by the control unit.

24. A system for controlling exercise equipment, comprising:

a center of mass (COM) sensor configured to track a position of a body of a user on the exercise equipment over time;

one or more additional sensors configured to track off-center movements of the user over time; and a control unit configured to modulate an adjustable parameter of the exercise equipment based on a plurality of measurements of the user's body position and off-center movements collected by the COM sensor and the one or more additional sensors over time and assign weights to the measurements from one or more responsive sensors of the COM sensor and the one or more additional sensors to compensate for a non-responsive sensor of the COM sensor and the one or more additional sensors when one of the COM sensor and the one or more additional sensors is determined to be non-responsive.

25. The system of claim 24, wherein the control unit is further configured to provide long-term user analytics or session analytics based on recorded sensor measurements and logged exercise equipment parameters over time.

26. A method of controlling exercise equipment, comprising:

tracking a position of a body of a user on the exercise equipment over time with a center of mass (COM) sensor coupled to or embedded within the exercise equipment;

tracking off-center movements of the user over time with one or more additional sensors coupled to or embedded within the exercise equipment;

modulating an adjustable parameter of the exercise equipment, with a control unit coupled to or embedded within the exercise equipment, based on a plurality of measurements of the user's body position and off-center movements collected by the COM sensor and the one or more additional sensors over time; and assigning weights to the measurements from one or more responsive sensors of the COM sensor and the one or more additional sensors to compensate for a non-responsive sensor of the COM sensor and the one or more additional sensors when one of the COM sensor and the one or more additional sensors is determined to be non-responsive.

* * * * *